US007553179B2

(12) United States Patent
Finona

(10) Patent No.: US 7,553,179 B2
(45) Date of Patent: Jun. 30, 2009

(54) CONNECTOR LATCH RETAINER

(75) Inventor: Michael Santos Finona, Lake Forrest, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/890,807

(22) Filed: Aug. 7, 2007

(65) Prior Publication Data

US 2009/0042454 A1 Feb. 12, 2009

(51) Int. Cl.
*H01R 13/627* (2006.01)

(52) U.S. Cl. ..... 439/352

(58) Field of Classification Search ..... 439/352, 439/533, 350

See application file for complete search history.

(56) References Cited

U.S. PATENT DOCUMENTS 4,332,432 A 6/1982 Colleran
4,973,268 A 11/1990 Smith et al.
5,389,014 A 2/1995 Kumpel et al.
5,681,184 A 10/1997 Pamart et al.
5,928,011 A 7/1999 Flask et al.
5,928,038 A 7/1999 Berg et al.
6,435,895 B1 8/2002 Fink et al.
6,595,790 B1 7/2003 Bigotto
6,716,052 B2 4/2004 Kane
6,780,045 B2 8/2004 Shuey et al.
6,916,196 B2 7/2005 Long et al.
6,939,159 B1 9/2005 Klein et al.
7,108,540 B2 * 9/2006 Annecke ..... 439/352

* cited by examiner

*Primary Examiner*—Felix O Figueroa
(74) *Attorney, Agent, or Firm*—Peter Van Winkle

(57) ABSTRACT

A connector system wherein a first connector (12) has a pair of latches (34, 36) that can be depressed to release them from a pair of strikes (30, 32) of a mating second connector (14). A retainer (60) is provided that prevents accidental release of the latches. The retainer has blocking parts (70) that move under the latches when the retainer is slid to a forward blocking position. The first connector has a pair of radially-projecting pins (84) at its laterally opposite sides, and the retainer has a pair of forwardly-projecting arms (80, 82) with slots (90) that each receives one of the pins. Each slot has a constriction (104) that resists sliding of the retainer away from its forward or rearward position.

5 Claims, 3 Drawing Sheets

CONNECTOR LATCH RETAINER

BACKGROUND OF THE INVENTION

One type of connector system includes first and second mateable connectors, wherein the first connector has a pair of pivoting latches and the second connector has a pair of stationary strikes that engage the latches when the connectors are brought together. Vibrations, shocks, temperature changes, pulling forces on cables extending from the connectors, etc. can cause the latches to accidently pivot open, free the strikes, and allow the connectors to unmate. A simple and low cost retainer for preventing accidental unlatching, which could be retrofitted onto present connectors with minimum changes, would be of value.

SUMMARY OF THE INVENTION

In accordance with one embodiment of the invention, a retainer is provided for mounting on a first connector of a connector system, to assure that latches on the first connector do not accidently disengage from strikes on a second connector of the system. The first connector has an axis and has a pair of opposite pins projecting radially outward from opposite sides of the first connector frame. The retainer is a plastic molded part that includes a short sleeve that is slidably mounted on the first connector frame, and that has a pair of locking arms that are held in forward and rearward positions by the pins. In the forward locking position of the arms, latch blocking parts on the retainer have been moved forward under the latches to prevent the latches from moving radially inwardly to release the strikes. The retainer can be slid rearward to move the blocking parts out of the way so the latches release the latches.

Each of the locking arms forms a slot that slidably receives one of the pins in forward-rearward sliding of the retainer. Each slot has a constriction where the slot is of smaller width than the pin to prevent the retainer from sliding unless a large force, on the order of magnitude of five pounds, is applied to slide the retainer. The constriction keeps the retainer in the position (block or unblock position) to which it has been slid until a large force is applied.

The novel features of the invention are set forth with particularity in the appended claims. The invention will be best understood from the following description when read in conjunction with the accompanying drawings.

DESCRIPTION OF THE PREFERRED EMBODIMENT

Figure 1:
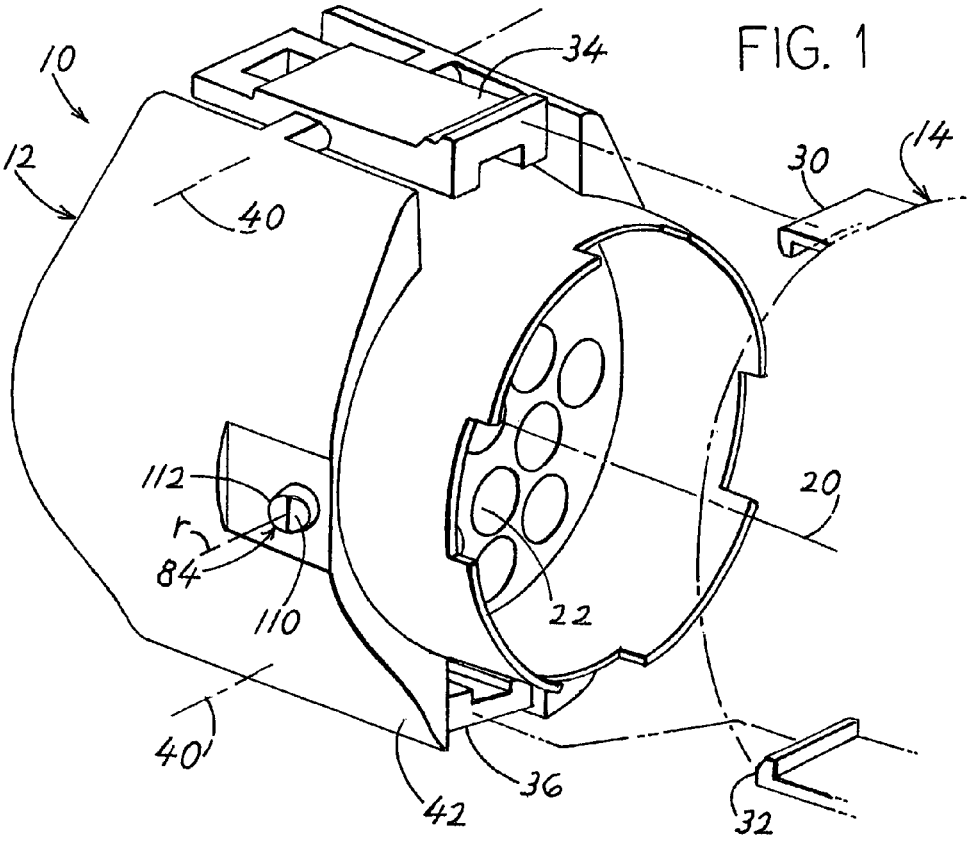
FIG. 1 is an isometric exploded view of a connector system of the present invention, without the retainer.

FIG. 1 illustrates a connector system 10 which includes two connectors 12, 14 that can mated by moving them together along a first connector axis 20. The first connector 12 has a group of first contacts lying in a group of passages 22, while the second connector has a group of mating second contacts that enter the passages and engage the first contacts. The second connector has a pair of strikes 30, 32, and the first connector has a pair of latches 34, 36 that engage the strikes when the connectors are moved fully together, to prevent the connectors from separating. Each latch is pivotally mounted about a pivot axis 40 on the housing or frame 42 of the first connector, and the two latches and two strikes operate in the same way. A spring (not shown) urges each latch such as latch 34, so a corresponding latch shoulder 44 (FIG. 5), located at a rear R end 46 of the latch, moves radially outward (away from the first axis 20), to lie rearward of a corresponding strike shoulder 50. However, as discussed earlier, it is possible for the latches to accidently release the strike and allow the connectors to unmate.

Figure 3:
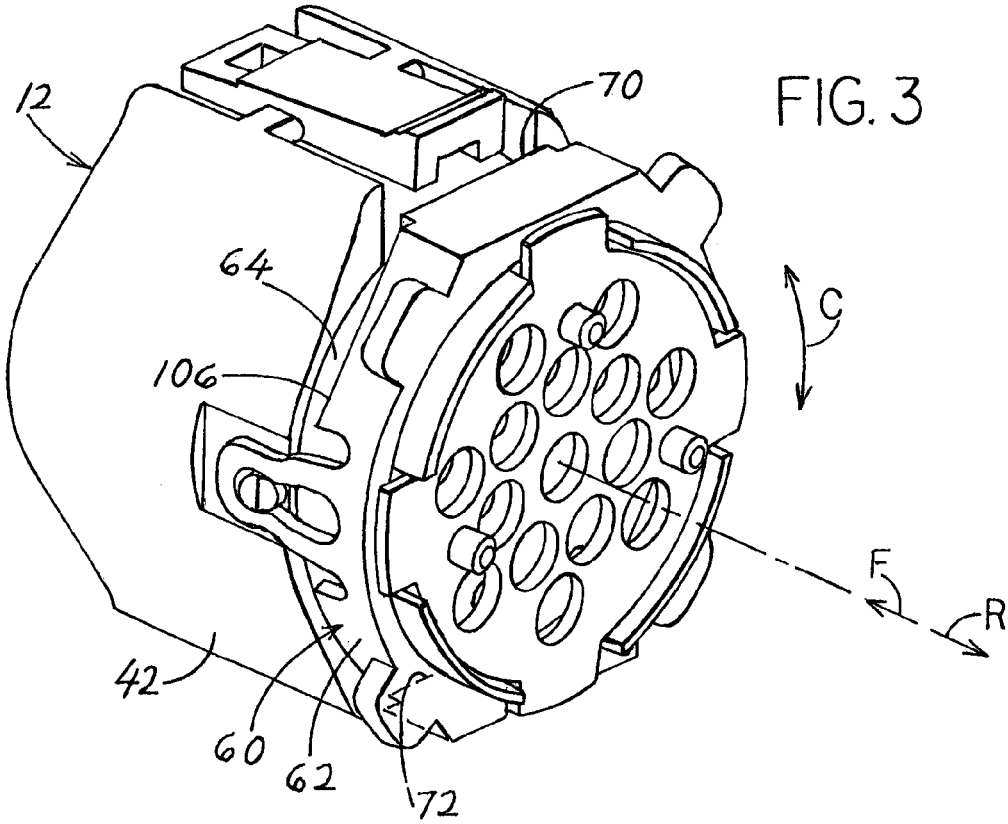
FIG. 3 is an isometric view of the first connector of the connector system of FIG. 1, with the retainer of FIG. 2 installed, and with a securing plate also mounted on the first connector, the retainer being in an unblocking position.
Figure 5:
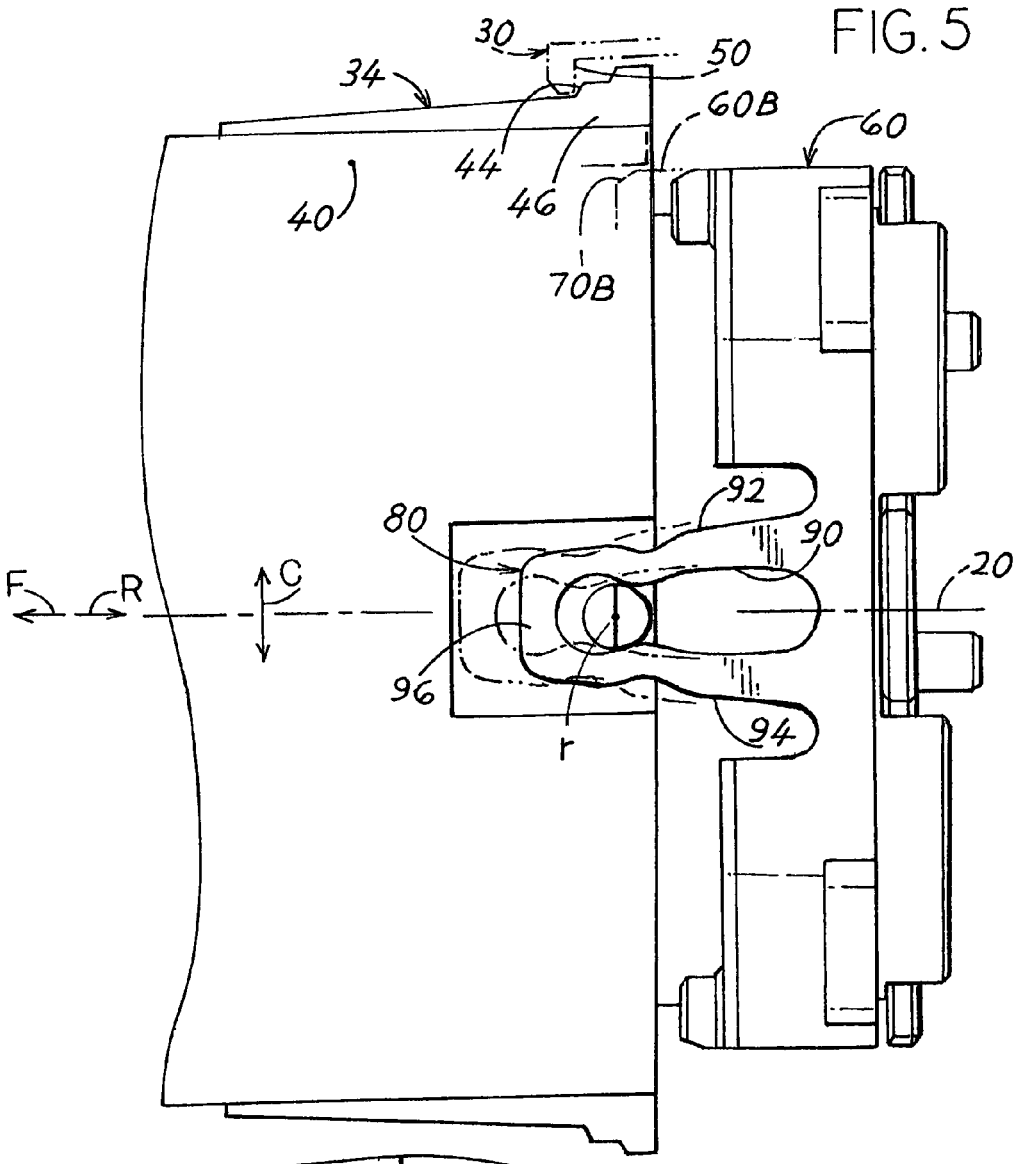
FIG. 5 is a partial side elevation view of the first connector of FIG. 3, with the retainer shown in phantom lines in its blocking position.

FIG. 3 shows a retainer 60 of the invention mounted on the first connector 12. The retainer includes a short sleeve 62 that extends closely around a part 64 of the cylindrical frame 42 of the first connector, which allows the sleeve to slide in forward F and rearward R directions thereon. The retainer has a pair of blocking portions 70, 72 that can block the latch rear ends from moving radially inward. FIG. 5 shows that when the retainer 60 moves forward to a blocking position at 60B, a blocking portion at 70B of the retainer moves "under", or radially inward (with respect to axis 20) of the latch rear end 46. This prevents the latch rear end 46 from being depressed to move radially inward, so the latch prevents release of the strike 30.

Figure 2:
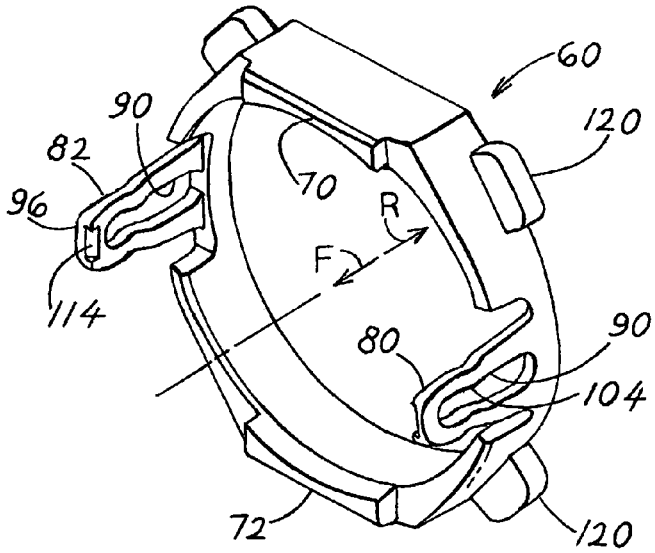
FIG. 2 is a rear isometric view of a retainer of the invention that is installable on the connector system of FIG. 1
Figure 6:
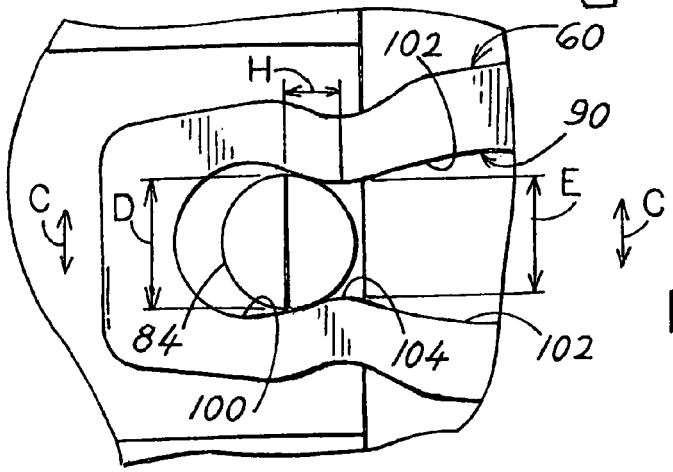
FIG. 6 is an enlarged view of a portion of a retainer arm and a connector pin of FIG. 5.

The retainer 60 (FIG. 2) or CPA (connector position assurance) device, is held on the first connector frame by a pair of locking arms 80, 82 that engage a pair of pins 84 (FIG. 1) that have been formed on the first connector frame. The pins project in directions radial (r) to the first connector axis 20. FIG. 5 shows that each arm such as 80, has a slot 90 that forms a pair of circumferentially C spaced fingers 92, 94 and a front connecting end 96 that connects front ends of the fingers. As shown in FIG. 6, the slot 90 has front and rear ends 100, 102 that each has a circumferential C width that is at least as large as the width D of the corresponding pin 84. The slot also has a constriction 104 with an undeflected width E that is smaller than the width D of the pin. The constriction can be forced past the pin by applying a large axial (F, R) force to the retainer. This causes deflection of opposite sides of the constriction in directions perpendicular to the radial direction (r in FIG. 1). The retainer 60 has an outside diameter of about 1.5inches and the pins 84 have diameters of about 0.1 inch. It requires an axial force on the order of magnitude of five pounds to move the constrictions of the two arms past the corresponding pins. The arms tend to move distances H of 0.04 inch between the center of the constriction and each location closest to the constriction where the slot diameter is the same as the pin diameter. A front end 106 (FIG. 3) of the retainer sleeve abuts a shoulder of the first connector frame to limit forward movement of the retainer.

Figure 4:
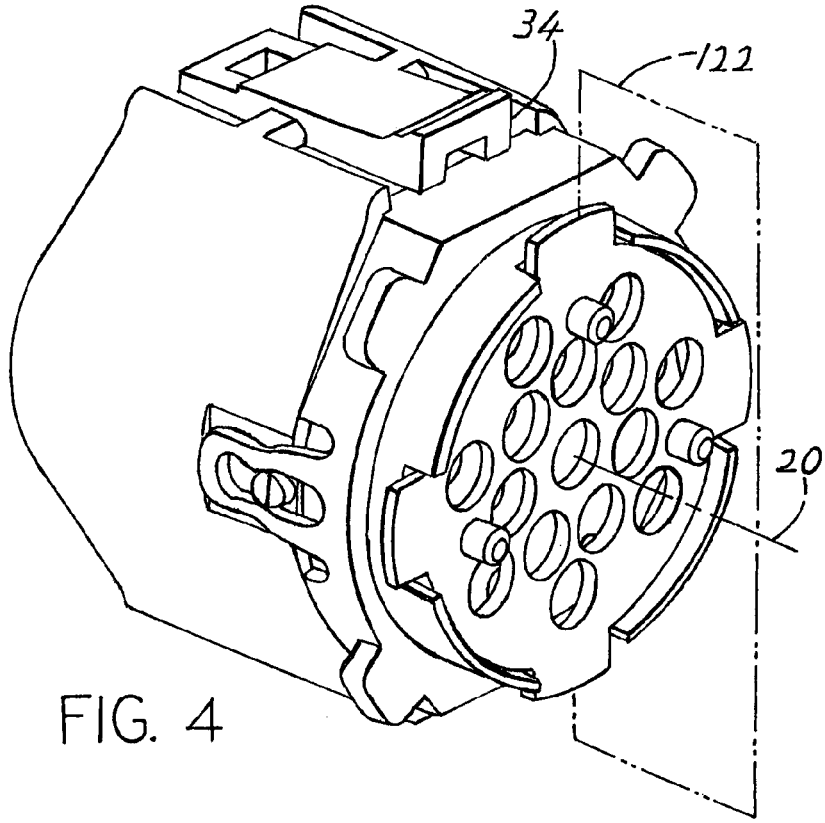
FIG. 4 is a view similar to that of FIG. 3, but with the retainer having been slid forward to its blocking position.

In a connector system that applicant has designed, each pin 84 (FIG. 6) had a diameter D of 0.10 inch and each constriction had a narrowest width E of 0.09 inch. It took a force of five pounds to move the constrictions of the two slots past the pins. As shown in FIG. 1, each pin has a forward and radially outward tapered rear part 110, and has a front shoulder 112. When the retainer is initially installed on the first connector frame, the front ends 96 (FIG. 5) of the arms ride over the pins. The front connector ends have tapered extreme front ends 114 (FIG. 2) to facilitate installation. Once the arms have slid far enough forward that the pins lie in the large diameter front ends 100 of slots, the front shoulders 112 of the pins prevent accidental removal of the arms and therefore of the retainer. The retainer has four radially-outward projecting tabs 120 to facilitate moving the retainer forward and rearward. The front connector and the retainer, are symmetric about a vertical plane 122 (FIG. 4) that passes through the axis 20 and through centers of the two latches 34, 36.

Thus, the invention provides a connector system that includes a first connector with a pair of vertically-spaced latches that can be manually deflected radially inward toward the connector axis, which includes a simple and low cost plastic retainer with blocking portions that can be moved to positions that prevent accidental deflection of the latches. The retainer includes a pair of horizontally, or laterally-space, locking arms that project forward from a sleeve portion of the retainer and that engage pins on the connector to urge the retainer to remain at one of two axial positions. The first connector has a pair of laterally-spaced pins and the arms each has a slot that receives a pin. Each slot has a constriction that resists axial movement of the retainer away from a forward position wherein the retainer blocks latch release.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector system which includes first and second connectors that are moveable together along an axis to mate, the first connector having a pair of pivoting latches and the second connector having a pair of strikes that are engageable by the latches, the latches being pivotable from a release position wherein the connectors can move apart to a latching position wherein the connectors are held together until the latches are pivoted back to the release position, including:

a retainer that has blocking parts and that is slideable rearward and forward on said first connector, in directions parallel to said axis, between respective unblock and block positions, that respectively allow and prevent pivoting of the latches toward the release position;

said first connector has a housing with a pair of pins that project in radial directions that are radial to said axis, and said retainer has a pair of locking arms that are each slideably engaged with one of said pins as said retainer slides between said unblock and block positions, said locking arms having locking arm parts that are only in directions perpendicular to said radial directions between said unblock and block positions.

2. The connector system described in claim 1, wherein:

said locking arm parts are resiliently deflectable in directions that are perpendicular to said rearward-forward directions as well as said radial directions, with only the resilience of said arm parts resisting movement of said retainers between said unblock and block positions.

3. A connector system which includes first and second connectors that are moveable together along an axis to mate, the first connector having a pair of pivoting latches and the second connector having a pair of strikes that are engageable by the latches, the latches being pivotable from a release position wherein the connectors can move apart to a latching position wherein the connectors are held together until the latches are pivoted back to the release position, including:

a retainer that has blocking parts and that is slideable rearward and forward on said first connector, in directions parallel to said axis, between respective unblock and block positions, that respectively allow and prevent pivoting of the latches toward the release position;

said first connector has a housing and said retainer has a pair of locking arms that are each slideably engaged with said first connector housing as said retainer slides between said unblock and block positions;

said first connector has a pair of radially outwardly projecting pins;

each of said locking arms forms walls of a slot that receives one of said pins, said slot walls of each arm comprising circumferentially spaced fingers that are resiliently deflectable apart and that form a constriction that resists constriction sliding forward and rearward past the pin.

4. The connector system described in claim 3 wherein:

each of said slot walls has a front connecting end that connects front ends of said fingers;

each of said pins has a tapered rear portion that is tapered at a forward and radially outward incline to allow said front connecting end to slide over the pin during installation of the retainer on said first connector.

5. A connector system which includes first and second connectors that are moveable together along an axis to mate, the first connector having a pair of pivoting latches and the second connector having a pair of strikes that are engageable by the latches, the latches being pivotable from a latching position wherein the connectors are held together to a release position wherein the connectors are free to move apart including:

a retainer that has blocking parts and that is slidable on said first connector parallel to said axis between unblock and block positions to respectively allow and prevent pivoting of the latches toward said release positions;

a pair of radially outwardly projecting pins on said first connector;

said retainer has a pair of locking arms that are each slidably engaged with one of said projecting pins and that each has a part that resists sliding of the arm between said block position and said unblock position;

each of said locking arms has a slot that forms a pair of fingers that are circumferentially spaced with respect to said axis and that form a front end wall that connects front ends of said fingers;

said fingers of each arm are spaced apart by at least the circumferential width of a corresponding pin, except at a constriction where the fingers are closer together than said pin circumferential width, said retainer being formed of a polymer that can bend;

in said unblocking position of the arm, the pin lies forward of a center of said constriction, and in said block position of the arm the pin lies rearward of the center of said constriction.

* * * * *